US006053356A

United States Patent [19]

Emoff et al.

[11] Patent Number: 6,053,356

[45] Date of Patent: Apr. 25, 2000

[54] COUPON DISPENSER WITH SUCTION CUP MOUNTING

[75] Inventors: Michael J. Emoff, 811 E. Fourth St., Dayton, Ohio 45402; Mitch J. McGuire, Dayton, Ohio

[73] Assignee: Michael J. Emoff, Dayton, Ohio

[21] Appl. No.: 09/016,129

[22] Filed: Jan. 30, 1998

[51] Int. Cl.[7] ..... A47K 10/24

[52] U.S. Cl. ..... 221/45; 206/39.5

[58] Field of Search ..... 221/45, 33, 282, 221/283, 48, 56; 206/39.5, 39, 829; 248/206.3; 312/34.4, 50

[56] References Cited

U.S. PATENT DOCUMENTS

| | | | |
|---|---|---|---|
| 1,678,339 | 7/1928 | Horwitt | 221/35 |
| 1,739,801 | 12/1929 | Pitts | 248/206.3 |
| 2,098,477 | 11/1937 | Welsh | 221/45 |
| 2,256,204 | 9/1941 | Jameson | 221/45 |
| 2,915,271 | 12/1959 | Ruttger | 248/206.3 |
| 3,068,055 | 12/1962 | Lenzi et al. | 312/50 |
| 4,562,938 | 1/1986 | Loder | 221/46 |
| 4,623,073 | 11/1986 | Hansen | 221/45 |
| 4,770,320 | 9/1988 | Miles et al. | 221/33 |
| 4,805,331 | 2/1989 | Boggess et al. | 40/651 |
| 4,951,837 | 8/1990 | Lentsch | 221/45 |
| 4,953,746 | 9/1990 | Andriash | 221/35 |
| 4,986,440 | 1/1991 | Windorski | 221/45 |
| 5,083,765 | 1/1992 | Kringel | 271/118 |
| 5,097,981 | 3/1992 | Degasperi et al. | 221/3 |
| 5,401,547 | 3/1995 | Blackwell et al. | 428/40 |
| 5,435,511 | 7/1995 | Hsu | 248/206.3 |
| 5,470,138 | 11/1995 | Kump | 312/34.4 |
| 5,944,219 | 8/1999 | Emoff et al. | 221/45 |

FOREIGN PATENT DOCUMENTS

| | | |
|---|---|---|
| 186224 | 9/1935 | Switzerland . |
| WO 97/16109 | 5/1997 | WIPO . |

OTHER PUBLICATIONS

One page Photocopy of four photographs dated Oct. 17, 1997 showing prior art dispenser.

Two page Photocopy of six photographs taken for purpose of this IDS dated Feb. 10, 1998 showing a Comark–Bates coupons dispenser.

Commonly owned design application serial No. 29/083,032 filed Jan. 30, 1998.

Commonly owned utility application serial No. 08/652,031 filed May 21, 1996.

See accompanying Information Disclosure Statement regarding admitted prior art coupon pads formed from self–adhesive note papers.

Advertisement published by Allegro Electronics Corporation, Fremont, CA, admitted to be prior art.

Advertisement published by Ozen Sound Devices, Inc., New York, NY, admitted to be prior art.

*Primary Examiner*—Kenneth W. Noland
*Attorney, Agent, or Firm*—Roger S. Dybvig

[57] ABSTRACT

A coupon dispenser is provided with at least one suction cup and, preferably, a pair of suction cups, connected to the dispenser box so that the box can be directly mounted on a window, refrigerator/freezer door, or any other substantially flat and smooth surface capable of supporting a suction cup.

2 Claims, 2 Drawing Sheets

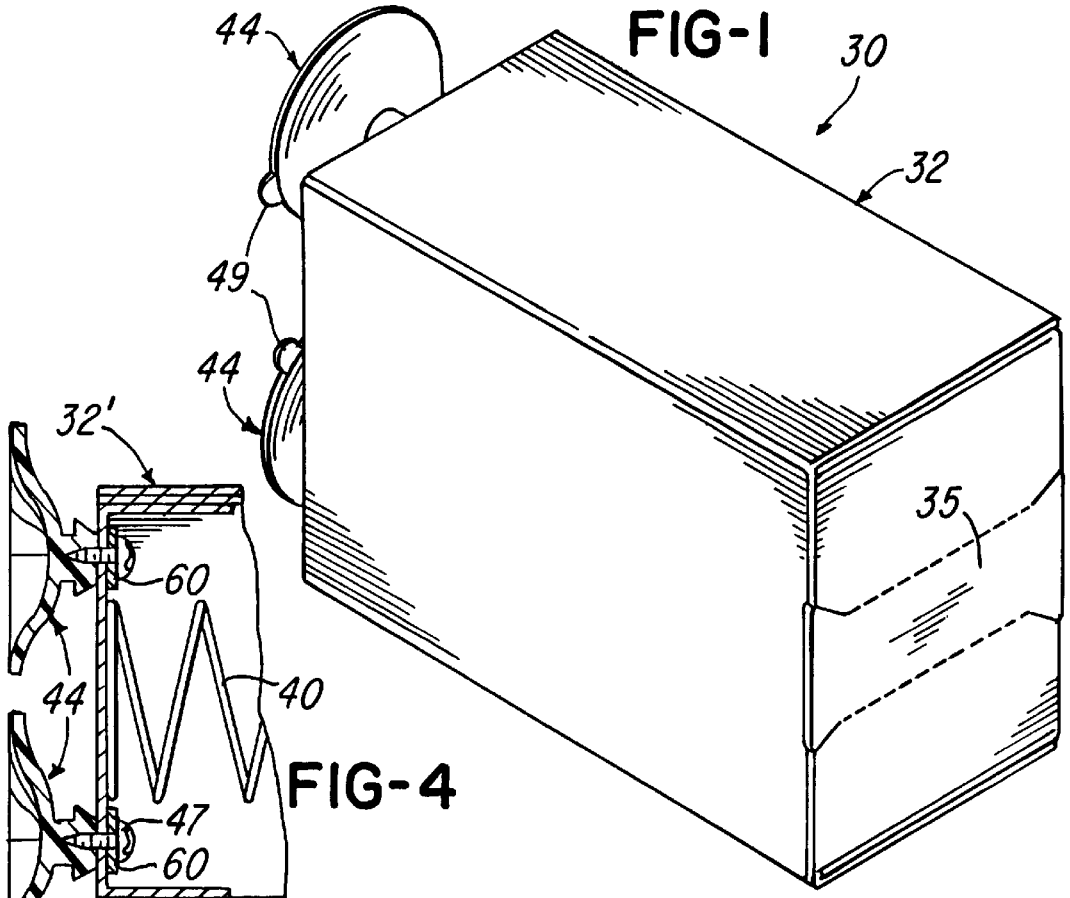
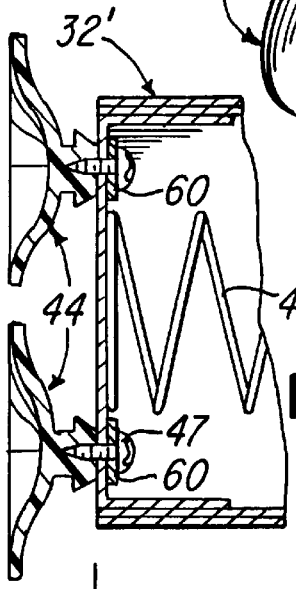
FIG-4
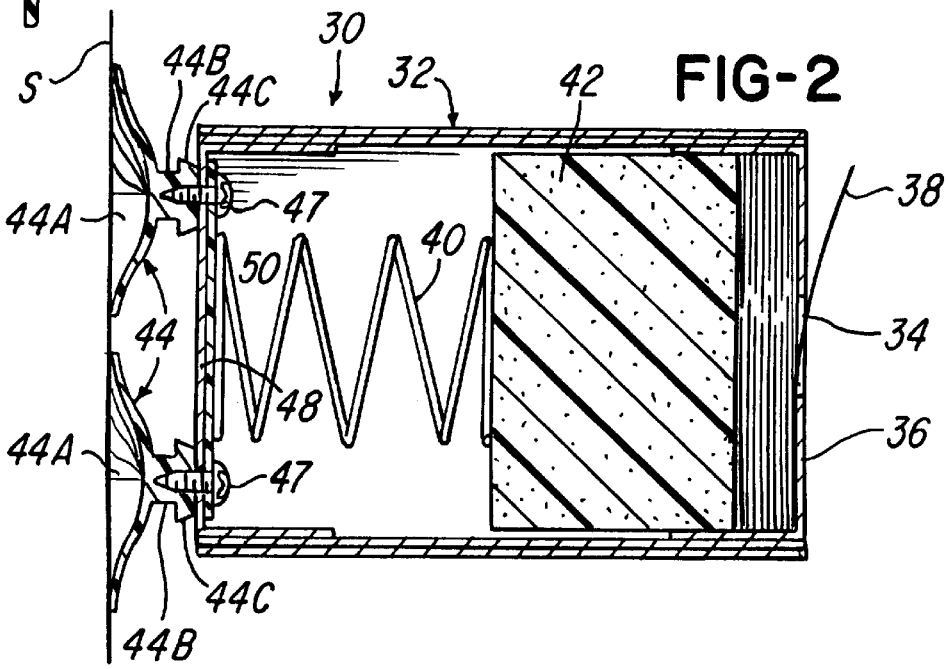
FIG-2

COUPON DISPENSER WITH SUCTION CUP MOUNTING

CROSS-REFERENCE TO RELATED APPLICATION AND INCORPORATION BY REFERENCE

The subject matter of this application is related to the subject matter of U.S. patent application, Ser. No. 08/652,031, filed May 21, 1996 now U.S. Pat. No. 5,944,219, by Michael J. Emoff and Mary Jayne Miller, now U.S. Pat. No. 5,944,219, dated Aug. 31, 1999, which is hereby incorporated by reference herein.

FIELD OF THE INVENTION

This invention is directed to a coupon dispenser with a suction cup mounting and may generally be characterized as a modification of the coupon dispensers shown in the abovementioned U.S. patent application, Ser. No. 08/652,031.

BACKGROUND OF THE INVENTION

The coupon dispenser disclosed in said U.S. patent application Ser. No. 08/652,031, comprises a pop-up dispenser box which houses a stack of small sheets, at least some of which are printed to form coupons. The dispenser box is provided with a flexible plastic cable tie for mounting the dispenser box on a wire rack, retail store shelf, or a cardboard display. Optionally, the box may be provided with a shelf clip for mounting onto a store shelf. There is thus provided an attractive, inexpensive coupon dispenser which does not require refilling or maintenance, as with more expensive reusable dispensers.

There are occasions in which a retailer may want to mount an inexpensive coupon dispenser onto a flat and smooth surface, such as a glass store window, a refrigerator/freezer door, deli case or counter top. Cable ties and shelf clips are unsuited for this purpose.

SUMMARY OF THE INVENTION

An object of this invention is to provide an inexpensive coupon dispenser of the type shown in said U.S. patent application Ser. No. 08/652,031 but which may be reliably mounted on a flat and smooth surface. A coupon dispenser in accordance with the present invention is provided with at least one suction cup and, preferably, a pair of suction cups, connected to the dispenser box so that the box can be directly mounted on a window, refrigerator/freezer door, or any other substantially flat and smooth surface capable of supporting a suction cup, such as the front of a deli case window or a counter top. The coupon dispenser is so constructed that there is a strong and stable connection between the box and the suction cup or cups.

Other objects and advantages will become apparent from the following description and claims and from the accompanying drawings.

BRIEF DESCRIPTION OF THE DRAWINGS

FIG. 1 is a top, front and left side perspective view of the coupon dispenser as it appears before use;

FIG. 2 is a vertical cross-sectional view of the coupon dispenser of FIG. 1 mounted on a vertical surface.

FIG. 4 is a fragmentary vertical cross section of a portion of a modified coupons dispenser in accordance with this invention.

DETAILED DESCRIPTION

Figure 3:
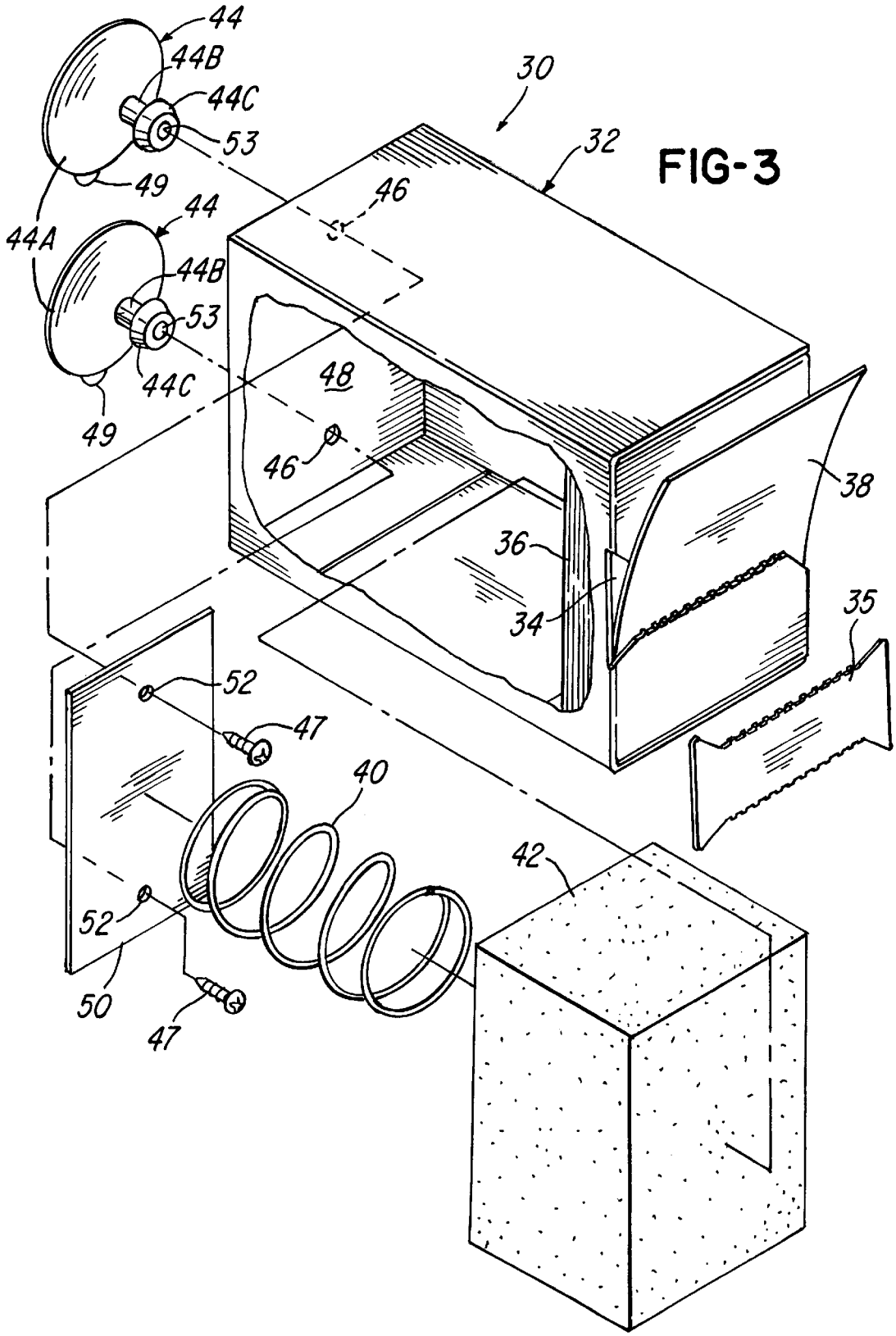
FIG. 3 is a partly exploded perspective view of the coupon dispenser of FIGS. 1 and 2.

With reference to the drawings, a coupon dispenser, generally designated 30, in accordance with this invention comprises a dispenser box 32 having a front wall with a central, transversely-extending box opening 34 normally closed by a tear-away portion 35. A stack 36 of small sheets 38, some or all of which have been printed to form coupons, is housed in the box 32.

As shown in FIG. 2, the stack 36 of sheets 38 is biased forwardly into engagement with the inner surface of the front wall of the box 32 by a biasing assembly comprising a coil spring 40 and a pressure pad 42 confined within the inside of the box 32. The spring 40 may be made from metal and the pressure pad 42 from a plastic foam material. Other biasing assemblies could be used, it being only important for purposes of this invention that the sheets 38 are biased toward the box opening 34 in the front wall of the box 32.

Each of the sheets 38 preferably has a repositionable, pressure sensitive adhesive strip along one bottom margin thereof and preferably comprise those marketed under the trademark POST-IT by 3M Company of St. Paul, Minn., which have been printed to be usable as merchandise coupons. They may be made from paper or other suitable material, such as a polymeric material as taught in U.S. Pat. No. 4,770,320, coated with a strip of repositionable adhesive. The sheets are preferably stacked in accordion fashion so that the adhesive strip on a sheet 38 being pulled from the top of the stack 36, pulls the next sheet 38 in the stack 36 partly outwardly through the box opening 34. 3M Company markets a dispenser box of accordion-stacked POST-IT notes with such a coil spring and a foam plastic pressure pad under the trademark POP N JOT. POP N JOT dispensers can readily be modified to produce a coupon dispenser in accordance with this invention.

As an alternative to the repositionable adhesive found on conventional POST-IT brand notes and the like, the sheets 38 may be provided with a strip of non-repositionable, "one-shot" adhesive that vanishes, fades, evaporates, or otherwise dissipates once a sheet 38 is removed from the stack of sheets 36. Such a non-repositionable adhesive would permit a sheet 38 to be pulled partly outwardly through the box opening 34 upon removal of the top sheet 38, but would not permit the removed sheet 38 to then be re-adhered to another object. The details of such a non-repositionable adhesive do not form a part of this invention and, therefore, are not described further herein.

As a further alternative, the sheets 38 could be made without an adhesive coating provided that they are stacked or folded in such fashion that a free margin of one sheet 38 is presented to the opening 34 when another sheet 38 is removed through the opening 34.

In accordance with the preferred embodiment of this invention, a pair of suction cups 44 are mounted on the dispenser box 32 for mounting the dispenser box on a flat and smooth surface, such as the surface designated "S" in FIG. 2. The suction cups 44 are of a well-known type having a round disk-like cup base 44A with a stem 44B having a mushroom cap 44C and having a central bore 53 at its upper end for receiving a mounting screw 47. The suction cups 44 are each respectively aligned with apertures 46 (FIG. 3) in the rear wall, designated 48, of the box 32 such that the suction cups 44 are outside the box 32. A pair of mounting screws 47 have heads located within the inside rear wall 48 of the box 32 and extend through the rear wall 48 into threaded engagement with the suction cup stems 44B. In addition to being inexpensive and easy to use, suction cups 44 of this type can readily be removed by lifting release tabs 49 projecting from the cup bases 44A. Such suction cups are available from several sources, such as Suction Cups, Inc. of Greenpoint, N.Y.

With reference to FIGS. 2 and 3, a thin, plastic stiffening plate 50 is preferably located within the box 32, lying flush against the inside surface of its rear wall 48. The plate 50 may be held against the inside surface of the rear wall 48 by the spring 40 and the mounting screws 47, and optionally could be attached to the rear wall 48 by a suitable adhesive (not shown). The plate 50, which may be injection molded or could be die cut from a sheet of plastic, has apertures 52 aligned with the bottom wall apertures 46. As shown in FIG. 3, the mounting screws 47 extend through both pairs of aligned apertures 52 and 46 and are threadedly received by center bores 53 in the upper ends of the stems 44B. The heads of the mounting screws 47 bear firmly against the innermost surface of the stiffening plate 50 to create a rigid connection between the suction cups 44 and the dispenser-box 32.

FIG. 4 shows a modified coupon dispenser in accordance with this invention in which a pair of washers 60 are located between the heads of the mounting screws and the inside surface of the rear wall 48 of the dispenser box, designated 32'. The washers 60 are used instead of the stiffening plate 50 of the embodiment of FIGS. 1 through 3 to cooperate with the screws 47 to create a rigid connection between the dispenser box 32' and the suction cups 44.

It will be noted that the particular dispenser box 32 illustrated in the drawings is in the form of a rectangular parallelepiped with its sides, top, and bottom having longer edges and the front and rear of the box having shorter edges. The spring 40 is round and has a diameter which is less than the length of the smaller edges of the box 32. In FIGS. 2 and 3, the apertures 46 and 52 are shown spaced apart by a distance greater than the diameter of the spring 40 so that the rear coil of the spring 40 bears down on and presses against the stiffening plate 50. Of course, other configurations of the box 32 are possible.

Suction cups other than those provided with mushroom caps may be used in the practice of this invention. Suction cup stems having mushroom caps are preferred because of the substantial contact area with the dispenser box 32 provided by the mushroom caps. The relatively large area of contact thus provided along with the stiff construction resulting from the use of the stiffening plate 50 through which the mounting screws 47 extend contribute to the stability and the sturdiness of the dispenser 30.

It will be evident that a dispenser box could be made with only one suction cup. However, a single suction cup does not provide as sturdy a structure because the bottom box wall 48 could pivot or twist around the axis of the stem of a single suction cup. The use of two suction cups substantially reduces such twisting of the box. Two suction cups are adequate for the purposes of this invention, but it is evident that three (or more) cups could be used.

In one application, a coupon dispenser 30 in accordance with this invention filled with printed manufacturer's coupons can be supplied to a retailer who can attach the box 32 to a window, refrigerator/freezer door, or any substantially flat surface. Customers can remove the coupons one-at-a-time and, if the coupons are provided with a repositionable adhesive, adhere them to the product for which the coupon is redeemable. Dispensers in accordance with this invention can be made so cheaply that, after they are emptied, they can be discarded and replaced at low cost.

It will be apparent that the dispenser box 32 could be provided with an LED display as taught in said U.S. patent application Ser. No. 08/652,031.

Although the presently preferred embodiments of this invention have been described, it will be understood that within the purview of the invention various changes may be made within the scope of the following claims.

Having thus described our invention, we claim:

1. A coupon dispenser comprising:

a dispenser box having an opening at its front end and a rear wall and a pair of apertures extending through said rear wall;

a stiffening plate located on the inner surface of said rear wall, said stiffening plate having a pair of apertures aligned with said apertures in said rear wall;

a stack of sheets within said dispenser box, at least some of which are printed as coupons; and a pair of suction cups connected to said box for mounting said box on a substantially flat and smooth surface, each said suction cup having a stem for receiving a mounting screw, and a pair of mounting screws extending from the interior of said box through both of said pairs of apertures into threaded engagement with the stems of said suction cups.

2. A coupon dispenser comprising:

a dispenser box having an opening at its front end and a rear wall and an aperture extending through said rear wall;

a stiffening plate located on the inner surface of said rear wall, said stiffening plate having an aperture aligned with said aperture in said rear wall;

a stack of sheets within said dispenser box, at least some of which are printed as coupons; and a suction cup connected to said box for mounting said box on a substantially flat and smooth surface, said suction cup having a stem for receiving a mounting screw, and a mounting screw extending from the interior of said box through both said apertures into threaded engagement with the stem of said suction cup.

* * * * *